US008207919B2

(12) United States Patent
Lu et al.

(10) Patent No.: US 8,207,919 B2
(45) Date of Patent: Jun. 26, 2012

(54) METHOD FOR ADJUSTING WHITE BALANCE IN A FIELD SEQUENTIAL DISPLAY AND DEVICE THEREOF

(75) Inventors: Qi-Ming Lu, Changhua County (TW); Chih-Sheng Chou, Taichung (TW); Hung-Hsiang Chen, Taipei County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 749 days.

(21) Appl. No.: 12/358,257

(22) Filed: Jan. 23, 2009

(65) Prior Publication Data

US 2010/0045579 A1 Feb. 25, 2010

(30) Foreign Application Priority Data

Aug. 20, 2008 (TW) ..... 97131700 A

(51) Int. Cl.
*G09G 3/32* (2006.01)

(52) U.S. Cl. ..... 345/83

(58) Field of Classification Search ..... None
See application file for complete search history.

(56) References Cited

U.S. PATENT DOCUMENTS

| | | | | |
|---|---|---|---|---|
| 7,598,961 | B2 * | 10/2009 | Higgins | 345/589 |
| 7,696,964 | B2 * | 4/2010 | Lankhorst et al. | 345/82 |
| 7,859,554 | B2 * | 12/2010 | Young | 345/690 |
| 2003/0111533 | A1 | 6/2003 | Chang | |

* cited by examiner

*Primary Examiner* — Hoa T Nguyen
*Assistant Examiner* — Mark Fischer
(74) *Attorney, Agent, or Firm* — Winston Hsu; Scott Margo

(57) ABSTRACT

A method for adjusting white balance includes generating a first matrix according to values in axes of a color gamut corresponding to optical characteristics of a plurality of first LEDs; generating a second matrix according to values in the axes of the color gamut corresponding to optical characteristics of the plurality of first LEDs while in white balance; generating a third matrix according to values in the axes of the color gamut corresponding to optical characteristics of a plurality of second LEDs; storing the first matrix, second matrix, and third matrix; generating a calibration matrix by multiplying the second matrix with an inverse of the first matrix; generating a fourth matrix by multiplying the third matrix with the calibration matrix. As a result, the optical characteristics of the plurality of second LEDs can be effectively and rapidly adjusted simply referring to the differences between the second and fourth matrices.

12 Claims, 10 Drawing Sheets

METHOD FOR ADJUSTING WHITE BALANCE IN A FIELD SEQUENTIAL DISPLAY AND DEVICE THEREOF

BACKGROUND OF THE INVENTION

1. Field of the Invention

The present invention relates to a method for adjusting white balance and device thereof, especially to a method for adjusting white balance in an FSD and device thereof.

2. Description of the Prior Art

The methods for color mixture while displaying images on a display can be divided into two categories: a time method and a spatial method. The time method for color mixture utilizes different time axes for the three primary light sources, RGB (red, green, and blue), to pass through, such as the color concurrent method and the color sequential method. Both methods utilize the photogene phenomenon of the human eyes to sense the color-mixing result. The spatial method for color mixture is, for example, the strip alignment method. Take the TFT-LCD (Thin Field Transistor Liquid Crystal Display) as an example, applied with the strip alignment method, each pixel in the TFT-LCD is composed of RGB sub-pixels filtered by the color filter, and each sub-pixel is smaller than the angle of view that a person can sense. Therefore, when a person watches the TFT-LCD panel, he senses the color-mixing result generated by the RGB lights emitted from those RGB sub-pixels respectively. Please refer to FIG. 1. FIG. 1 is the diagram of the color concurrent method, the color sequential method, and the strip alignment method. So far the strip alignment method with a color filter is the mainstream of the color-mixing method applied in LCD panels; however, the color sequential method is gradually tending to catch up with the strip alignment method. Compared with the strip alignment method, the color sequential method has advantages of:

1. high resolution;
2. capable of performing color balance;
3. with no color filter.

With the above advantages, the performance of the system is better, the size of the system can be decreased, and the structure of the cavity of liquid crystal is simplified. A display applied with the color sequential method is called a field sequential liquid crystal display (FS-LCD).

Please refer to FIG. 2. FIG. 2 is a block diagram of conventional driving circuitry 10 of an FS-LCD. There are a video source 12 for offering video frequency signals, an FS-LCD controller 14, a memory 16, a display panel 18, and a backlight module 20 in the conventional driving circuitry 10 of FIG. 2. As shown in FIG. 2, the parallel RGB video frequency signals and the control signals are inputted from the video source 12 to the FS-LCD controller 14. The FS-LCD controller 14 further includes buffers F1 and F2, a converter 141, and a memory I/O 143. The buffer F1 is for receiving the video frequency signals transmitted from the video source 12, such as the parallel RGB video frequency signals and the control signals. The converter 141 is for converting the parallel RGB video frequency signals into the serial RGB video frequency signals. The buffer F2 is for outputting the serial RGB video frequency signals transmitted from the converter 141. The memory I/O 143 is for inputting/outputting the signals from/to the memory 16. After receiving the video frequency signals transmitted from the video source 12 by the buffer F1, the buffer F2 outputs the control signals to the backlight module 20 and the serial RGB video frequency signals converted from the parallel RGB video frequency signals by the converter 141 to the display panel 18. When the buffer F2 outputs the control signals to the backlight module 20, the FS-LCD controller 14 controls the backlight module 20 synchronously to light up corresponding light sources of the backlight module 20 according to the RGB signals intended to be shown on the display panel 18.

Please refer to FIG. 3. FIG. 3 is the schematic diagram of driving circuitry 200 of a backlight module 20 of a conventional FS-LCD. The driving circuitry 200 of the backlight module 20 includes a red LED (light emitting diode) series 202, a green LED series 204, a blue LED series 206, switches 212, 214, and 216, a DC power source 208, a ground source 210, and resistors 222, 224, and 226. The resistor 222 is electrically connected between the DC power source 208 and the red LED series 202, the resistor 224 is electrically connected between the DC power source 208 and the green LED series 204, and the resistor 226 is electrically connected between the DC power source 208 and the blue LED series 206. The switch 212 is electrically connected between the red LED series 202 and the ground source 210, the switch 214 is electrically connected between the green LED series 204 and the ground source 210, and the switch 216 is electrically connected between the blue LED series 206 and the ground source 210.

The driving circuitry 200 of the backlight module 20 lights up the LED series of different colors through controlling the corresponding switches 212, 214, and 216 according to different RGB signals intended to be shown on the display panel 18. Please refer to FIG. 4. FIG. 4 is the conventional driving wave form of the backlight module 20 of an FS-LCD. From FIG. 4, we can see that after a red part of an image signal is written into the driving circuitry 200 of the backlight module 20, the red LED series 202 of the backlight module 20 will be lighted up accordingly. Then a green part of the image signal is written into the driving circuitry 200 of the backlight module 20, and the green LED series 204 of the backlight module 20 will be lighted up accordingly. Lastly a blue part of the image signal is written into the driving circuitry 200 of the backlight module 20, and the blue LED series 206 of the backlight module 20 will be lighted up accordingly. As shown in FIG. 4, due to the fixed switch cycle of the LEDs, adjusting the luminance of the LEDs only can rely on adjusting the resistance values of the resistors 222, 224, and 226 in FIG. 3. In the prior art, the resistance values of the resistors 222, 224, and 226 are adjusted manually so as to control the currents flowing through the corresponding LEDs of the backlight module 20. However, the adjusted luminance of the LEDs can only be judged through human eyes, therefore the outcome of the judgment is not very precise; and moreover, it is difficult to fine tune the resistance values through a manual operation. As a result, a color shift will be generated in the image quite often while performing the prior art method (for example, the image becomes reddish or bluish), and the white balance in the image becomes worse.

SUMMARY OF THE INVENTION

One embodiment of the present invention releases a method for adjusting white balance in an FSD comprising: generating a first matrix according to values in axes of a color gamut corresponding to optical characteristics of at least one first red, green, and blue light emitting diodes (LEDs) respectively; storing the first matrix; generating a second matrix according to values in the axes of the color gamut corresponding to the optical characteristics of the at least one first red, green, and blue LEDs respectively while in white balance; storing the second matrix; generating a third matrix according to values in the axes of the color gamut corresponding to optical characteristics of at least one second red, green, and blue LEDs respectively; storing the third matrix; generating a calibration matrix by multiplying the second matrix with an inverse of the first matrix; generating a fourth matrix by multiplying the third matrix with the calibration matrix; and adjusting the optical characteristics of the at least one second red, green, and blue LEDs referring to differences between the second and fourth matrices.

Another embodiment of the present invention further releases a method for adjusting white balance in an FSD comprising: generating a first matrix according to values in axes of a color gamut corresponding to optical characteristics of at least one first red, green, and blue LEDs respectively; storing the first matrix; generating a second matrix according to values in the axes of the color gamut corresponding to the optical characteristics of the at least one first red, green, and blue LEDs respectively while in white balance; storing the second matrix; generating a calibration matrix by multiplying the second matrix with an inverse of the first matrix; storing the calibration matrix; generating a third matrix according to values in the axes of the color gamut corresponding to optical characteristics of at least one second red, green, and blue LEDs respectively; storing the third matrix; calculating a fourth matrix by multiplying the third matrix with the calibration matrix; and adjusting the optical characteristics of the at least one second red, green, and blue LEDs referring to differences between the second and fourth matrices.

Another embodiment of the present invention further releases a device for adjusting white balance in an FSD comprising a first device, a second device, a third device, a storing device, a calculating device, and an adjusting device. The first device is for generating a first matrix according to values in axes of a color gamut corresponding to optical characteristics of at least one first red, green, and blue LEDs respectively. The second device is for generating a second matrix according to values in the axes of the color gamut corresponding to the optical characteristics of the at least one first red, green, and blue LEDs respectively while in white balance. The third device is for generating a third matrix according to values in the axes of the color gamut corresponding to optical characteristics of at least one second red, green, and blue LEDs respectively. The storing device is for storing the first matrix, the second matrix, and the third matrix. The calculating device is for generating a calibration matrix by multiplying the second matrix with an inverse of the first matrix, and generating a fourth matrix by multiplying the third matrix with the calibration matrix. The adjusting device is for adjusting the optical characteristics of the at least one second red, green, and blue LEDs referring to differences between the second and fourth matrices.

Another embodiment of the present invention further releases a device for adjusting white balance in an FSD comprising a first device, a second device, a third device, a storing device, a calculating device, and an adjusting device. The first device is for generating a first matrix according to values in axes of a color gamut corresponding to optical characteristics of at least one first red, green, and blue LEDs respectively. The second device is for generating a second matrix according to values in the axes of the color gamut corresponding to the optical characteristics of the at least one first red, green, and blue LEDs respectively while in white balance. The calculating device is for calculating a calibration matrix by multiplying the second matrix with an inverse of the first matrix. The third device is for generating a third matrix according to values in the axes of the color gamut corresponding to optical characteristics of at least one second red, green, and blue LEDs respectively. The storing device is for storing the first matrix, the third matrix, and the calibration matrix. The adjusting device is for adjusting the optical characteristics of the at least one second red, green, and blue LEDs referring to differences between the second and a fourth matrices, wherein the fourth matrix is generated by multiplying the third matrix with the calibration matrix through the calculating device.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ." Also, the term "electrically connect" is intended to mean either an indirect or direct electrical connection. Accordingly, if one device is coupled to another device, that connection may be through a direct electrical connection, or through an indirect electrical connection via other devices and connections.

Aimed at the disadvantages of the prior art, the present invention discloses an adjusting mechanism for adjusting white balance of images shown in the FS-LCD through changing the light-emitting time of the LEDs of the backlight module, or through adjusting the currents flowing through the LEDs of the backlight module with considerations of the optical characteristics of both the LEDs and the display panel.

Figure 1:
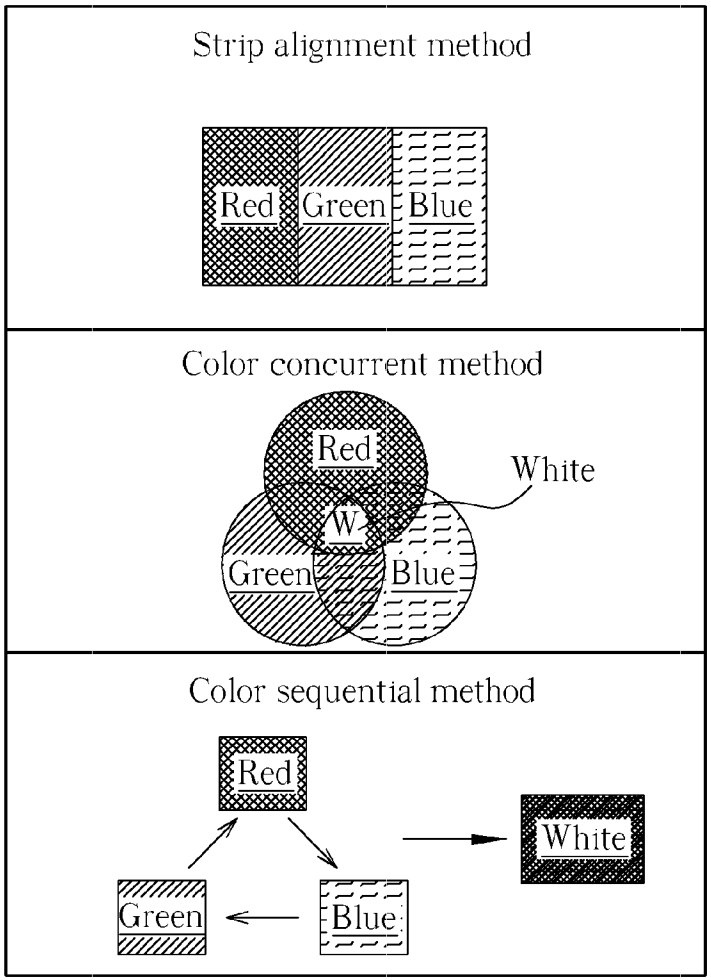
FIG. 1 PRIOR ART
FIG. 1 is the diagram of the color concurrent method, the color sequential method, and the strip alignment method.
Figure 2:
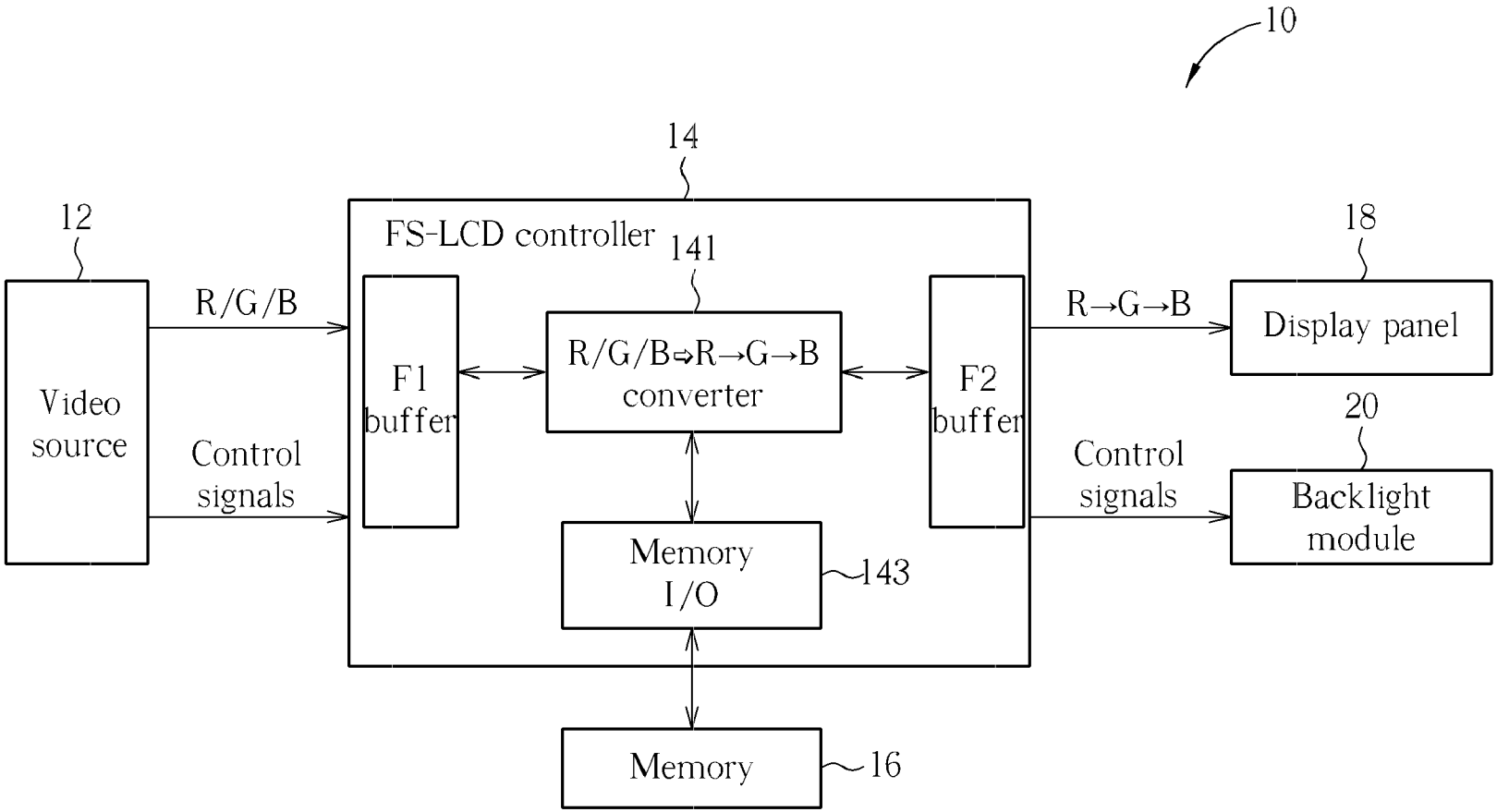
FIG. 2 PRIOR ART
FIG. 2 is a block diagram of conventional driving circuitry of an FS-LCD.
Figure 3:
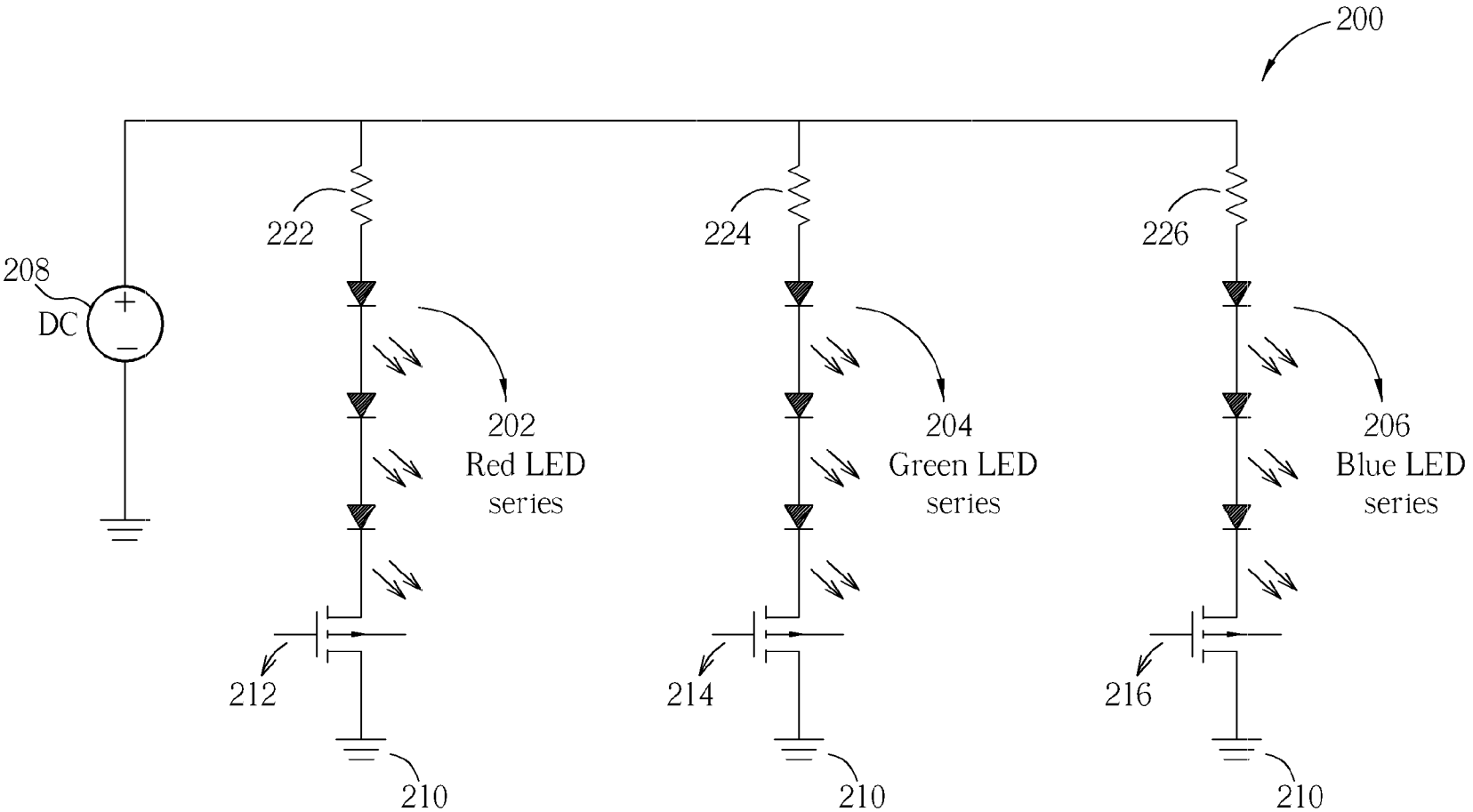
FIG. 3 PRIOR ART
FIG. 3 is the schematic diagram of conventional driving circuitry of a backlight module of an FS-LCD.
Figure 4:
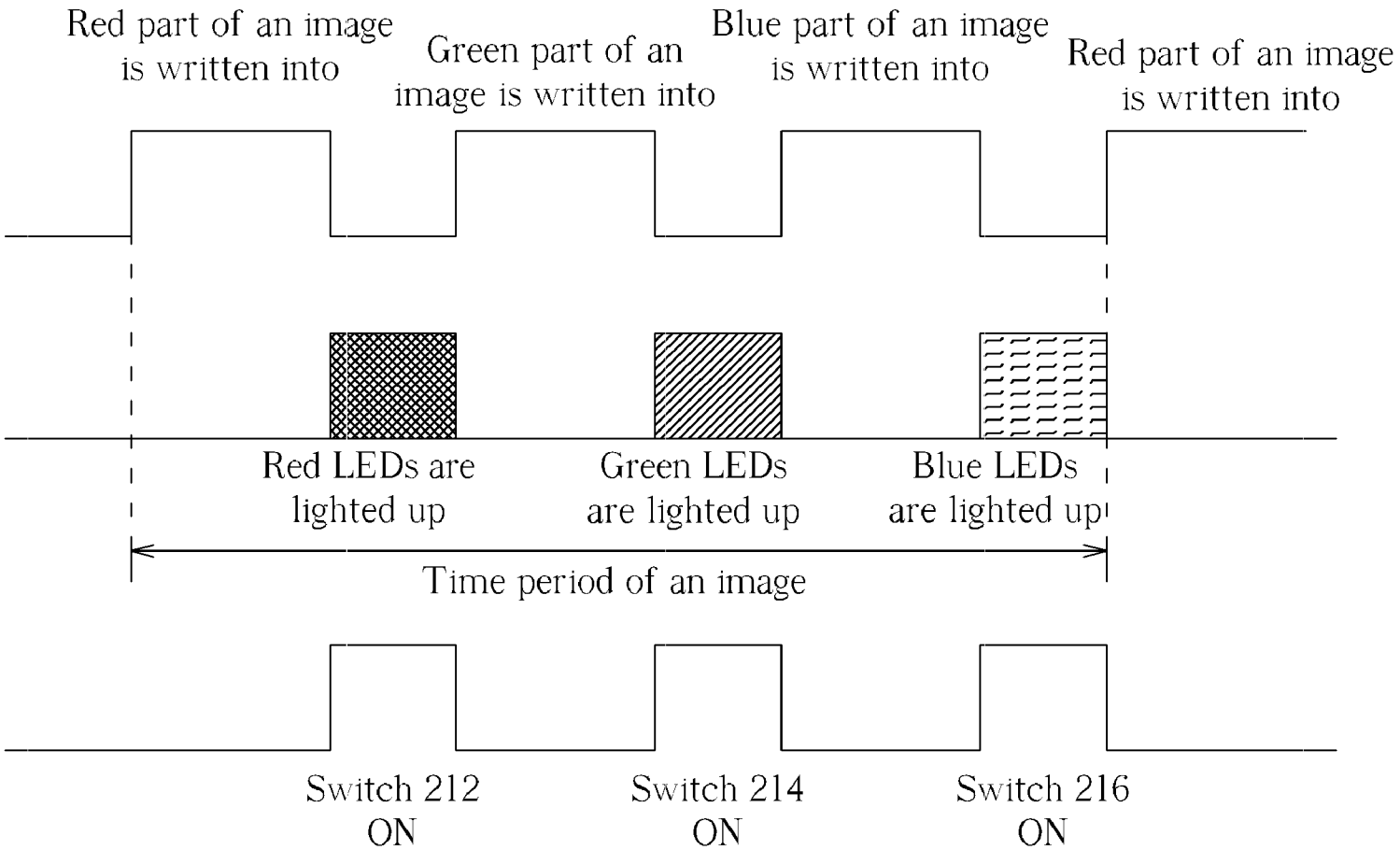
FIG. 4 PRIOR ART
FIG. 4 is the driving wave form of the backlight module of a conventional FS-LCD.
Figure 5:
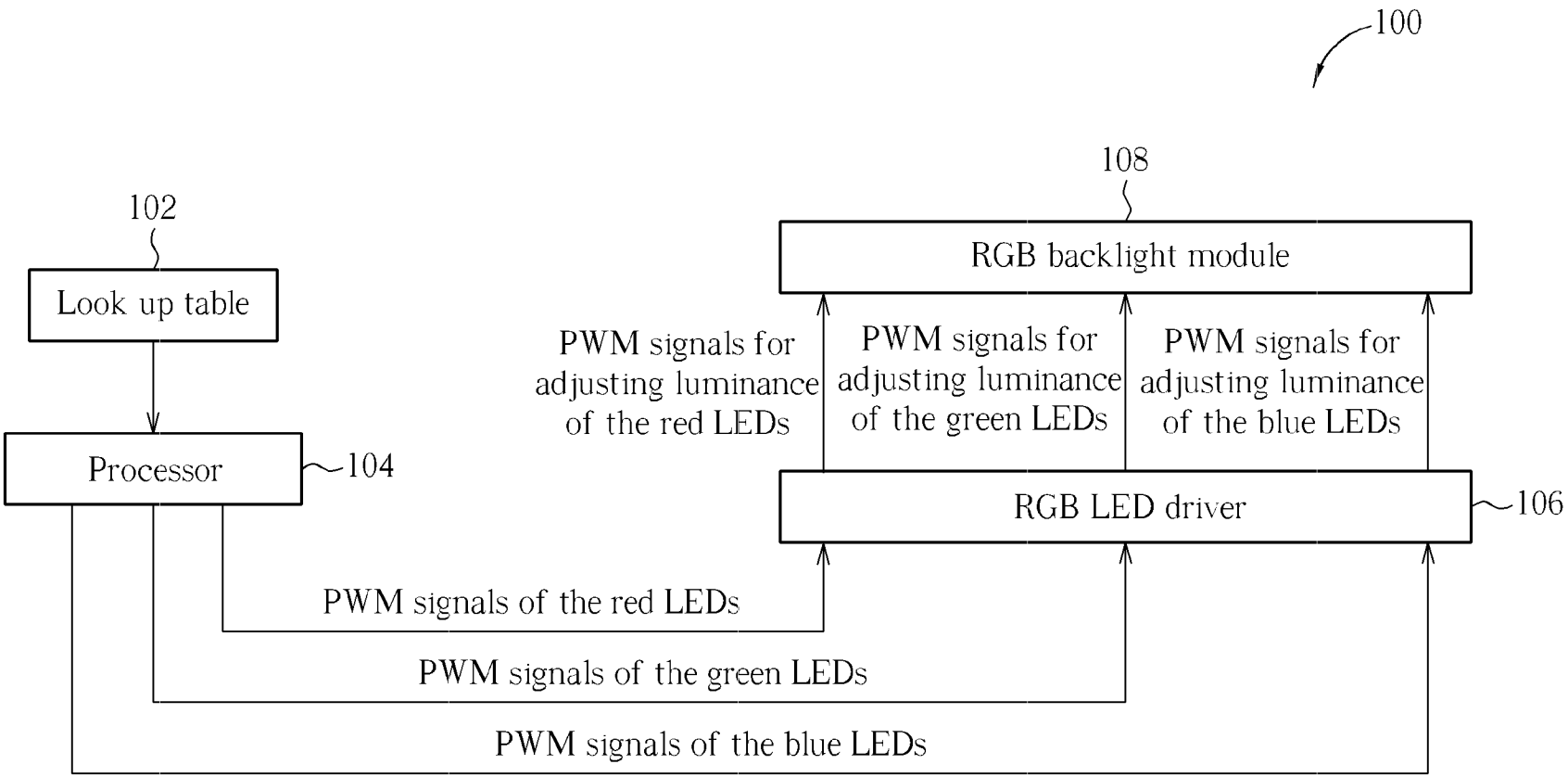
FIG. 5 is the block diagram of the system of the present invention.

Please refer to FIG. 5. FIG. 5 is the block diagram of the system 100 of the present invention. The system 100 includes a processor 104, a look up table 102, an RGB LED driver 106, and a backlight module 108. The backlight module 108 is composed by RGB LEDs. As shown in FIG. 5, the processor 104 outputs the RGB PWM (pulse width modulation) signals to the RGB LED driver 106, and then the RGB LED driver 106 outputs the RGB PWM signals for adjusting luminance of the RGB LEDs of the backlight module 108 to the backlight module 108. The process of the present invention can be concluded as follows: first, adjusting the luminance of the RGB LEDs of the backlight module 108 to white balance according to the optical characteristics of both the RGB LEDs of the backlight module 108 and the display panel; storing the related parameters into the look up table 102; and adjusting the backlight module intended to be adjusted to white balance according to the related parameters stored in the look up table 102 through outputting corresponding PWM signals or corresponding current signals transmitted from the processor 104 to the RGB LED driver 106 to change the luminance of the LEDs of the backlight module intended to be adjusted.

Figure 6:
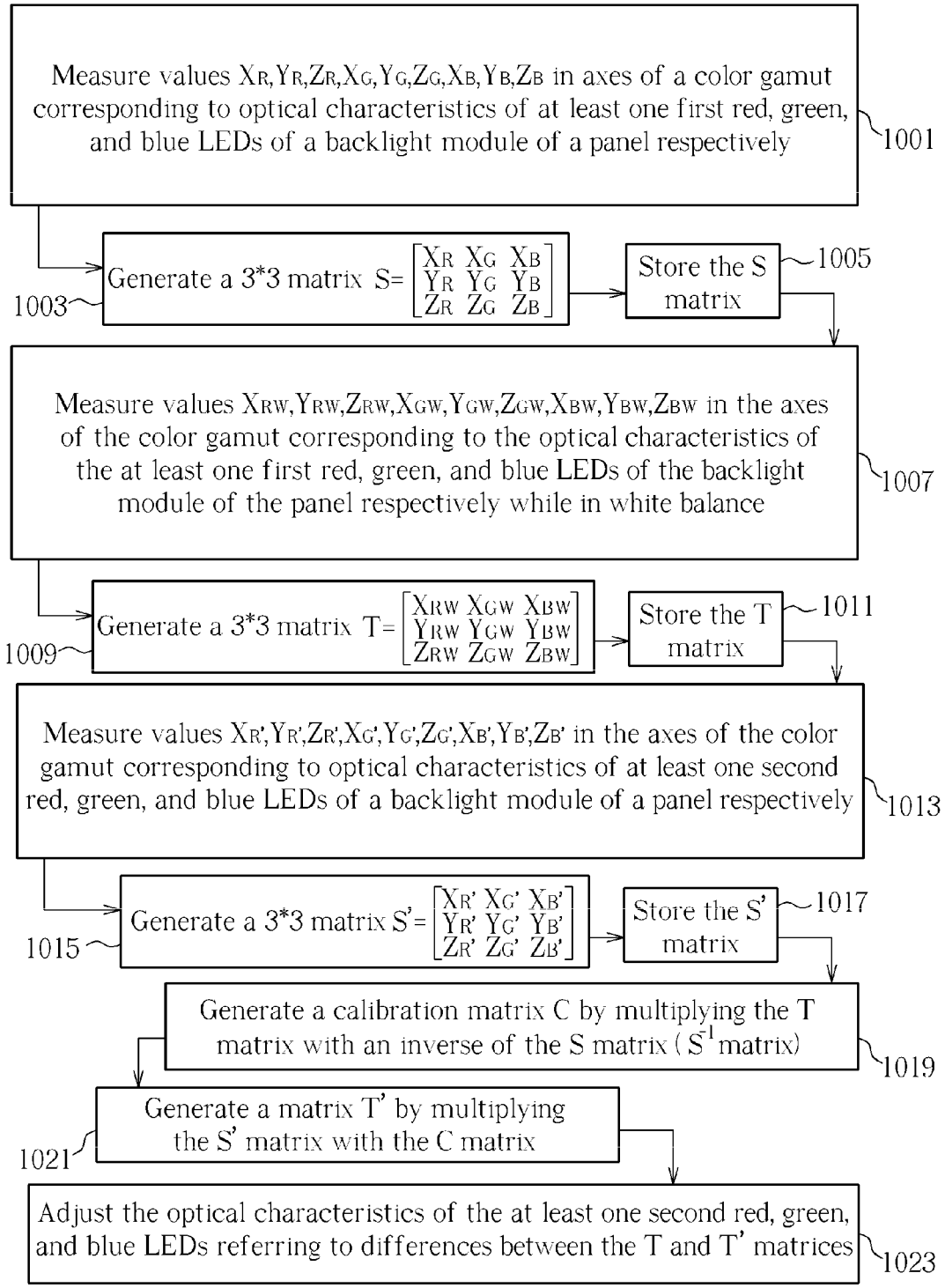
FIG. 6 is the flow chart of the first embodiment of the present invention.

Please refer to FIG. 6. FIG. 6 is the flow chart of the first embodiment of the present invention. The steps in FIG. 6 are explained as follows:

Step 1001: measure values $X_R, Y_R, Z_R, X_G, Y_G, Z_G, X_B, Y_B, Z_B$ in axes of a color gamut corresponding to optical characteristics of at least one first red, green, and blue LEDs of a backlight module of a panel respectively;

Step 1003: generate a 3*3 matrix $$S = \begin{bmatrix} X_R & X_G & X_B \\ Y_R & Y_G & Y_B \\ Z_R & Z_G & Z_B \end{bmatrix};$$

Step 1005: store the S matrix;

Step 1007: measure values $X_{RW}, Y_{RW}, Z_{RW}, X_{GW}, Y_{GW}, Z_{GW}, X_{BW}, Y_{BW}, Z_{BW}$ in the axes of the color gamut corresponding to the optical characteristics of the at least one first red, green, and blue LEDs of the backlight module of the panel respectively while in white balance;

Step 1009: generate a 3*3 matrix $$T = \begin{bmatrix} X_{RW} & X_{GW} & X_{BW} \\ Y_{RW} & Y_{GW} & Y_{BW} \\ Z_{RW} & Z_{GW} & Z_{BW} \end{bmatrix};$$

Step 1011: store the T matrix;

Step 1013: measure values $X_{R'}, Y_{R'}, Z_{R'}, X_{G'}, Y_{G'}, Z_{G'}, X_{B'}, Y_{B'}, Z_{B'}$ in the axes of the color gamut corresponding to optical characteristics of at least one second red, green, and blue LEDs of a backlight module of a panel respectively;

Step 1015: generate a 3*3 matrix $$S' = \begin{bmatrix} X_{R'} & X_{G'} & X_{B'} \\ Y_{R'} & Y_{G'} & Y_{B'} \\ Z_{R'} & Z_{G'} & Z_{B'} \end{bmatrix};$$

Step 1017: store the S' matrix;

Step 1019: generate a calibration matrix C by multiplying the T matrix with an inverse of the S matrix ($S^{-1}$ matrix);

Step 1021: generate a matrix T' by multiplying the S' matrix with the C matrix;

Step 1023: adjust the optical characteristics of the at least one second red, green, and blue LEDs referring to differences between the T and T' matrices.

The detailed description of the above steps are as follows: first measure values $X_R, Y_R, Z_R$, in axes of a color gamut corresponding to optical characteristics of at least one first red LED of a backlight module of a panel, and so measure values $X_G, Y_G, Z_G, X_B, Y_B, Z_B$ in the axes of the color gamut corresponding to optical characteristics of at least one first green and blue LEDs of the backlight module of the panel respectively to generate a 3*3 matrix S, and store the S matrix in the look up table 102. Next, adjust the backlight module and the panel to white balance, then measure values $X_{RW}, Y_{RW}, Z_{RW}, X_{GW}, Y_{GW}, Z_{GW}, X_{BW}, Y_{BW}, Z_{BW}$ in the axes of the color gamut corresponding to the optical characteristics of the at least one first red, green, and blue LEDs of the backlight module of the panel respectively while in white balance to generate a 3*3 matrix T and store the T matrix in the look up table 102. Subsequently, measure values $X_{R'}, Y_{R'}, Z_{R'}, X_{G'}, Y_{G'}, Z_{G'}, X_{B'}, Y_{B'}, Z_{B'}$ in the axes of the color gamut corresponding to optical characteristics of at least one second red, green, and blue LEDs of a backlight module of a panel respectively to generate a 3*3 matrix S', and store the S' matrix in the look up table 102. The S, T, and S' matrices are listed below:

$$S = \begin{bmatrix} X_R & X_G & X_B \\ Y_R & Y_G & Y_B \\ Z_R & Z_G & Z_B \end{bmatrix}$$

$$T = \begin{bmatrix} X_{RW} & X_{GW} & X_{BW} \\ Y_{RW} & Y_{GW} & Y_{BW} \\ Z_{RW} & Z_{GW} & Z_{BW} \end{bmatrix}$$

$$S' = \begin{bmatrix} X_{R'} & X_{G'} & X_{B'} \\ Y_{R'} & Y_{G'} & Y_{B'} \\ Z_{R'} & Z_{G'} & Z_{B'} \end{bmatrix}$$

Because the T matrix of white balance of the backlight module containing the at least one first red, green, and blue LEDs equals to the product of the S matrix and a calibration matrix C, hence the C matrix can be derived by multiplying the T matrix with the inverse matrix $S^{-1}$ of the S matrix. Please refer to Formula (1):

$$T = C*S \Rightarrow C = T*S^{-1} \qquad \text{Formula (1)}$$

Then use the C matrix to calibrate white balance in the backlight module containing the at least one second LEDs and the panel. The T' matrix of white balance of the backlight module containing the at least one second LEDs can be generated by multiplying the S' matrix with the C matrix. Please refer to Formula (2):

$$T' = C*S' \qquad \text{Formula (2)}$$

Lastly, according to the differences between the T and T' matrices, adjust the duty ratios of the PWM signals transmitted to or the currents flowing through the at least one second red, green, and blue LEDs to change the luminance of the at least one second red, green, and blue LEDs contained in the backlight module to get white balance.

Please note that the at least one second red, green, and blue LEDs are not necessary contained in the different backlight module from the one including the at least one first red, green, and blue LEDs. The first embodiment of the present invention also can be applied when parts of LEDs of the backlight module are broken, and are replaced with new LEDs. In such a case, the backlight module with new LEDs and the panel need to be readjusted to white balance, then these new LEDs can be treated as the aforementioned at least one second LEDs while applying the method of the present invention. In addition, provided that the result is substantially the same, the steps are not required to be executed in the exact order shown in FIG. 6.

Figure 7:
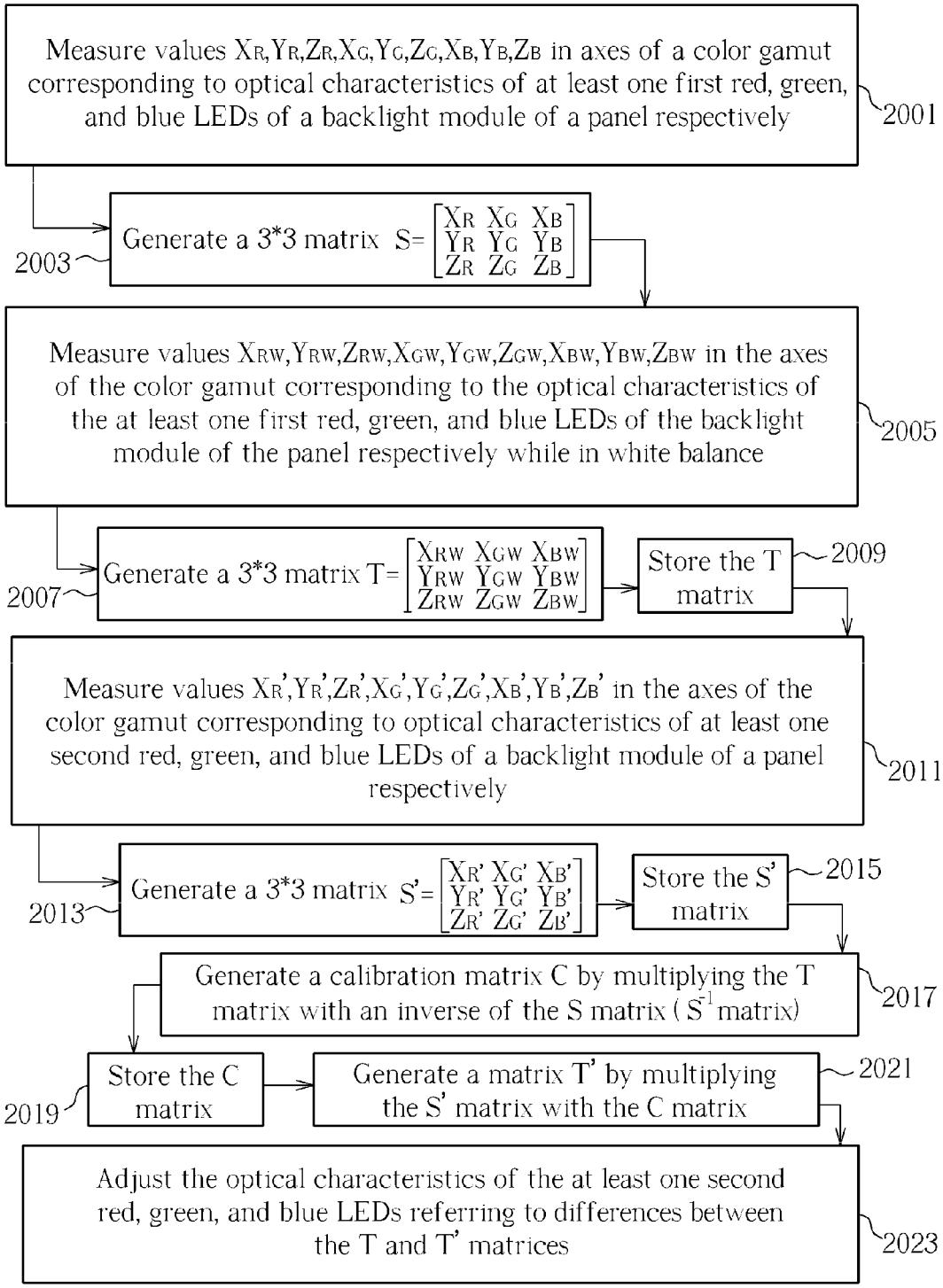
FIG. 7 is the flow chart of the second embodiment of the present invention.

Please refer to FIG. 7. FIG. 7 is the flow chart of the second embodiment of the present invention. The steps in FIG. 7 are explained as follows:

Step 2001: measure values $X_R, Y_R, Z_R, X_G, Y_G, Z_G, X_B, Y_B, Z_B$ in axes of a color gamut corresponding to optical characteristics of at least one first red, green, and blue LEDs of a backlight module of a panel respectively;

Step 2003: generate a 3*3 matrix $$S = \begin{bmatrix} X_R & X_G & X_B \\ Y_R & Y_G & Y_B \\ Z_R & Z_G & Z_B \end{bmatrix};$$

Step 2005: measure values $X_{RW}, Y_{RW}, Z_{RW}, X_{GW}, Y_{GW}, Z_{GW}, X_{BW}, Y_{BW}, Z_{BW}$ in the axes of the color gamut corresponding to the optical characteristics of the at least one first red, green, and blue LEDs of the backlight module of the panel respectively while in white balance;

Step 2007: generate a 3*3 matrix $$T = \begin{bmatrix} X_{RW} & X_{GW} & X_{BW} \\ Y_{RW} & Y_{GW} & Y_{BW} \\ Z_{RW} & Z_{GW} & Z_{BW} \end{bmatrix};$$

Step 2009: store the T matrix;

Step 2011: measure values $X_{R'}, Y_{R'}, Z_{R'}, X_{G'}, Y_{G'}, Z_{G'}, X_{B'}, Y_{B'}, Z_{B'}$ in the axes of the color gamut corresponding to optical characteristics of at least one second red, green, and blue LEDs of a backlight module of a panel respectively;

Step 2013: generate a 3*3 matrix $$S' = \begin{bmatrix} X_{R'} & X_{G'} & X_{B'} \\ Y_{R'} & Y_{G'} & Y_{B'} \\ Z_{R'} & Z_{G'} & Z_{B'} \end{bmatrix};$$

Step 2015: store the S' matrix;

Step 2017: generate a calibration matrix C by multiplying the T matrix with an inverse of the S matrix ($S^{-1}$ matrix);

Step 2019: store the C matrix;

Step 2021: generate a matrix T' by multiplying the S' matrix with the C matrix;

Step 2023: adjust the optical characteristics of the at least one second red, green, and blue LEDs referring to differences between the T and T' matrices.

In the second embodiment, the same as the first embodiment, the S matrix of no adjustment of the backlight module containing the at least one first red, green, and blue LEDs, the T matrix of white balance of the backlight module containing the at least one first red, green, and blue LEDs, and the S' matrix of no adjustment of the backlight module containing the at least one second red, green, and blue LEDs are generated as follows:

$$S = \begin{bmatrix} X_R & X_G & X_B \\ Y_R & Y_G & Y_B \\ Z_R & Z_G & Z_B \end{bmatrix}$$

-continued $$T = \begin{bmatrix} X_{RW} & X_{GW} & X_{BW} \\ Y_{RW} & Y_{GW} & Y_{BW} \\ Z_{RW} & Z_{GW} & Z_{BW} \end{bmatrix}$$

$$S' = \begin{bmatrix} X_{R'} & X_{G'} & X_{B'} \\ Y_{R'} & Y_{G'} & Y_{B'} \\ Z_{R'} & Z_{G'} & Z_{B'} \end{bmatrix}$$

Similar to the first embodiment, the calibration matrix C and the T' matrix of white balance of the backlight module containing the at least one second red, green, and blue LEDs are generated after performing the formula (1) and (2) listed below:

$$T=C*S=>C=T*S^{-1} \quad \text{Formula (1)}$$

$$T'=C*S' \quad \text{Formula (2)}$$

Lastly, the same as the first embodiment, adjust the duty ratios of the PWM signals transmitted to or the currents flowing through the at least one second red, green, and blue LEDs to change the luminance of the at least one second red, green, and blue LEDs contained in the backlight module to get white balance according to the differences between the T and T' matrices.

The difference between the first and second embodiments is the matrices stored in the look up table 102. The first embodiment stores matrices T, S, and S' in the look up table 102, however, the second embodiment stores matrices T, S', and C. As a result, every time while calculating the T' matrix of white balance of the backlight module containing the at least one second red, green, and blue LEDs, the method taught in the first embodiment of the present invention needs to perform the operation of $C=T*S^{-1}$ to generate the calibration matrix C, and then the operation of T'=C*S' to generate the T' matrix. However, the method of the second embodiment of the present invention only needs to perform the operation of T'=C*S' to generate the T' matrix of white balance of the backlight module containing the at least one second red, green, and blue LEDs.

Please note that, the same as the first embodiment, the at least one second red, green, and blue LEDs of the second embodiment are not necessary contained in the different backlight module from the one including the at least one first red, green, and blue LEDs. The second embodiment of the present invention also can be applied when parts of LEDs of the backlight module are broken, and are replaced with new LEDs. In addition, provided that the result is substantially the same, the steps are not required to be executed in the exact order shown in FIG. 7.

As to how to adjust the optical characteristics of the at least one second red, green, and blue LEDs contained in the backlight module to change the luminance of them to get white balance referring to the differences between the T and T' matrices, the present invention also releases two methods. One method is to change the duty ratios of the PWM signals transmitted to the backlight module containing the at least one second red, green, and blue LEDs, and the other method is to change the current signals flowing through the at least one second red, green, and blue LEDs contained in the backlight module.

Figure 8:
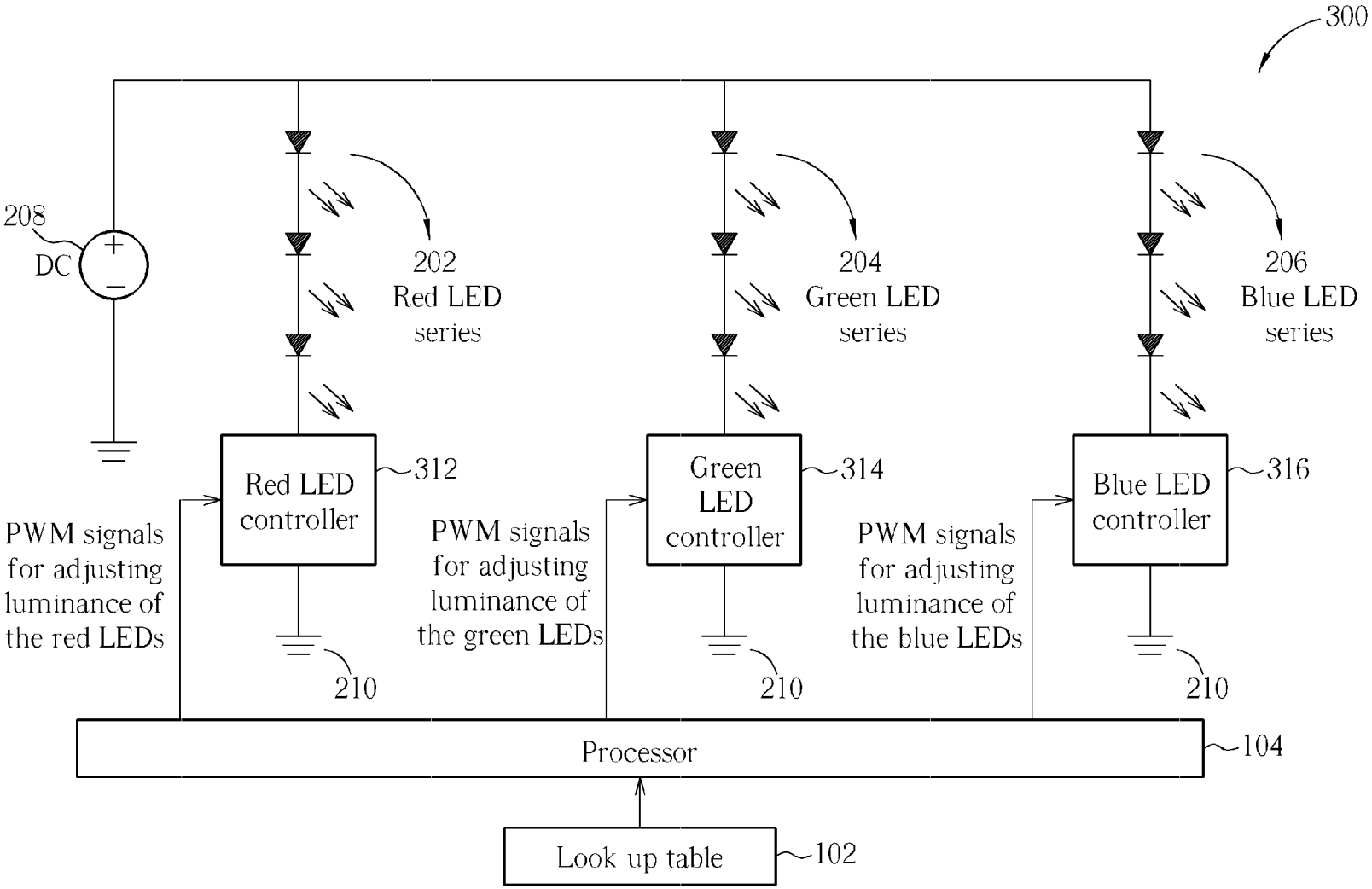
FIG. 8 is the driving circuitry of the backlight module of the FS-LCD according to the present invention.

As to the aforementioned first method, please refer to FIG. 8, FIG. 8 is the driving circuitry 300 of the backlight module 108 of the FS-LCD according to the present invention. The driving circuitry 300 of the backlight module 108 includes a red LED series 202, a green LED series 204, a blue LED series 206, a red LED controller 312, a green LED controller 314, a blue LED controller 316, a DC power source 208, a ground source 210, a processor 104, and a look up table 102. The red LED controller 312 is electrically connected between the red LED series 202 and the ground source 210, the green LED controller 314 is electrically connected between the green LED series 204 and the ground source 210, and the blue LED controller 316 is electrically connected between the blue LED series 206 and the ground source 210. The processor 104 calculates the new duty ratios of the PWM signals of the red, green, and blue LED series 202, 204, and 206 according to the difference between the T and T' matrices first, then transmits the new PWM signals to the red, green, and blue LED controllers 312, 314, and 316 respectively to change the luminance of the corresponding red, green, and blue LED series 202, 204, and 206.

Figure 9:
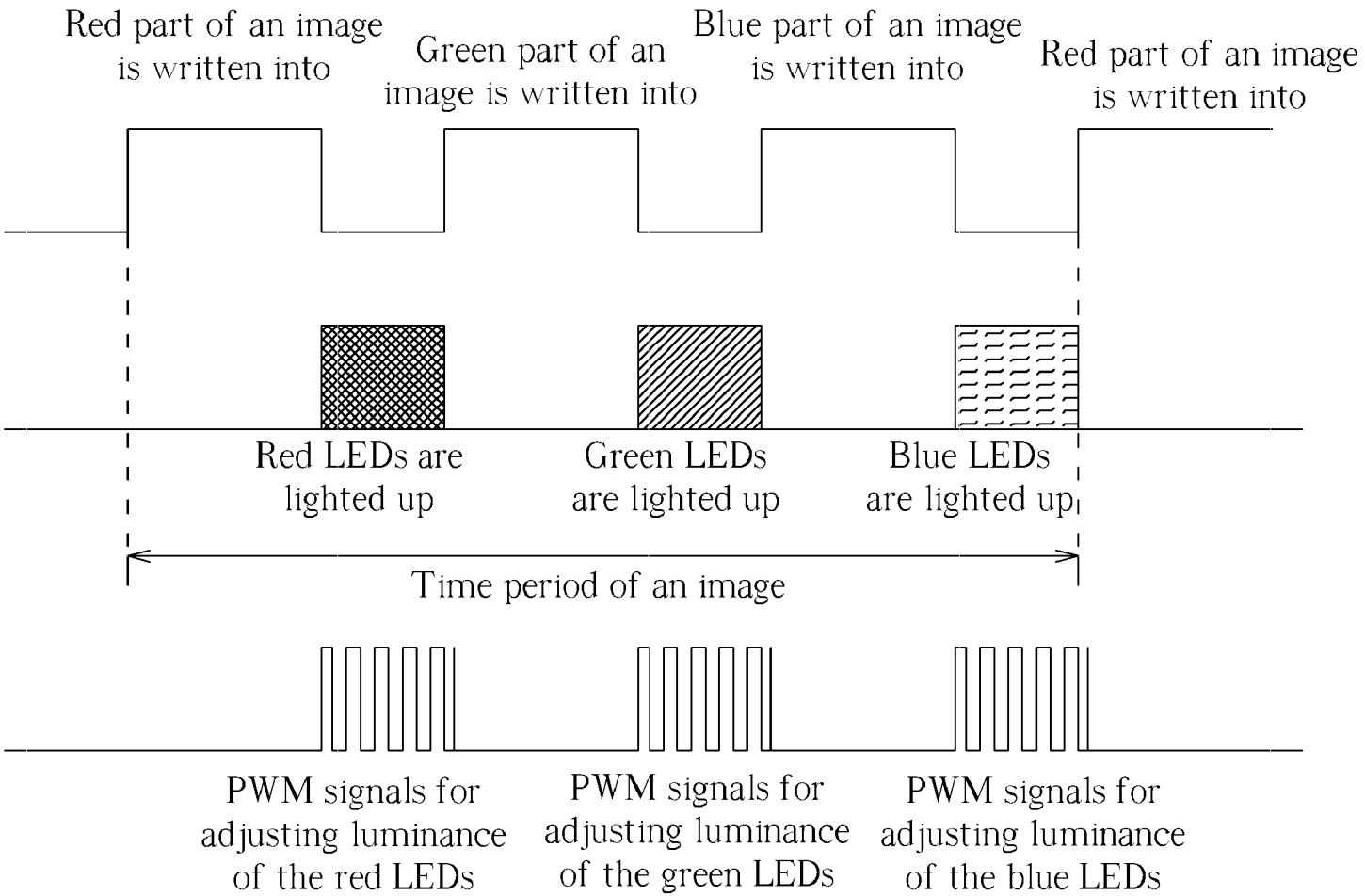
FIG. 9 is the driving wave form of the backlight module of the FS-LCD according to the present invention.

Please refer to FIG. 9. FIG. 9 is the driving wave form of the backlight module 108 of the FS-LCD according to the present invention. From FIG. 9, it can be seen that when a red part of an image signal is written into the backlight module 108, the red LED series 202 is lighted up correspondingly, and then a green part and a blue part of the image signal are written into the backlight module 108 in sequence, the green LED series 204 and the blue LED series 206 are lighted up in sequence correspondingly as a result. As shown in FIG. 9, the light-emitting cycles of the LEDs change according to the PWM signals, and thus, the luminance of the LEDs can be changed accordingly. Therefore, white balance in the FS-LCD can be derived.

Figure 10:
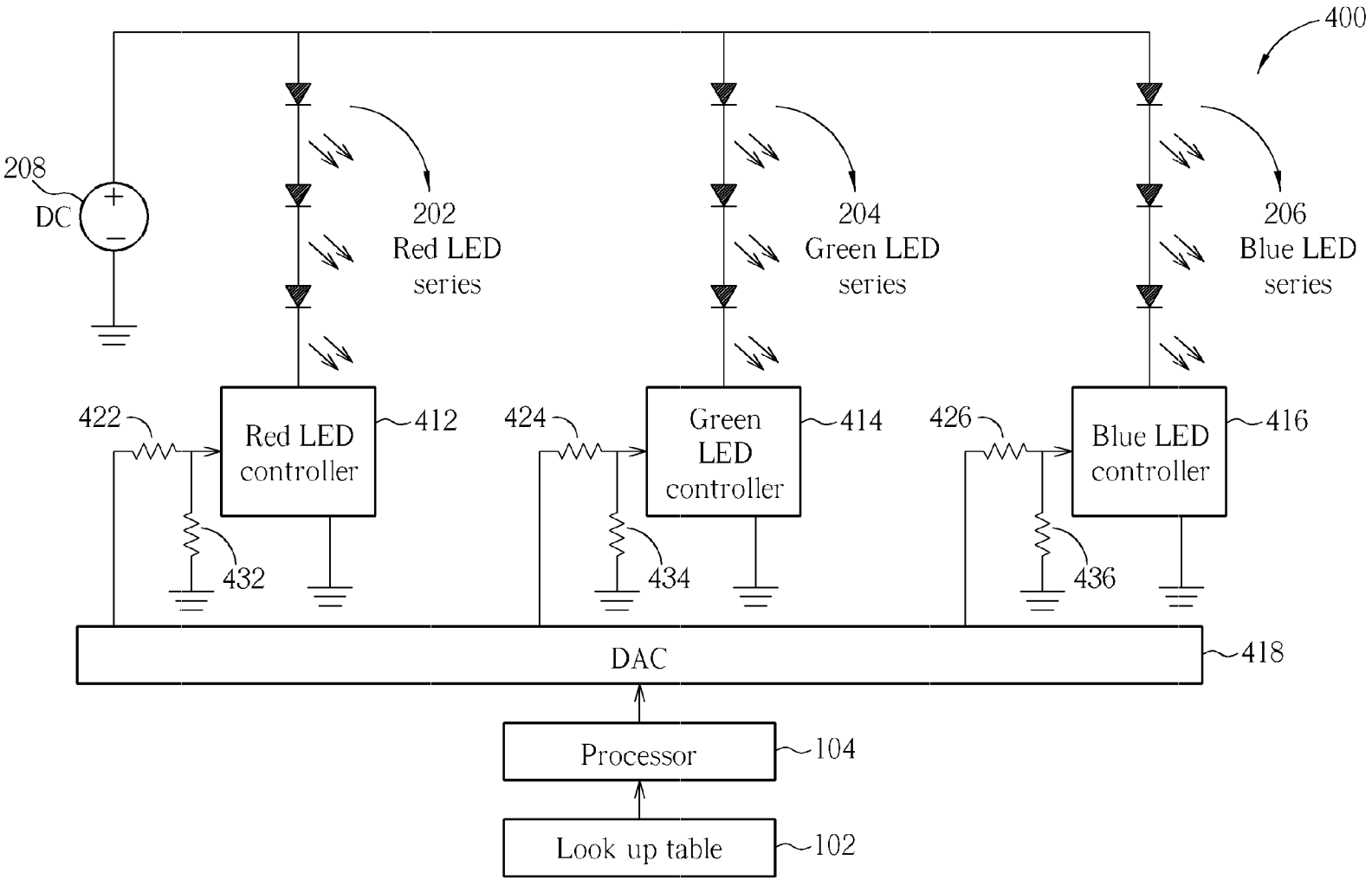
FIG. 10 is another driving circuitry of the backlight module of the FS-LCD according to the present invention

As to the aforementioned second method, please refer to FIG. 10, FIG. 10 is the driving circuitry 400 of the backlight module 108 of the FS-LCD according to the present invention. The driving circuitry 400 of the backlight module 108 includes a red LED series 202, a green LED series 204, a blue LED series 206, a red LED controller 412, a green LED controller 414, a blue LED controller 416, a DC power source 208, a ground source 210, a processor 104, a DAC (digital to analog converter) 418, resistor dividers 422, 432, 424, 434, 426, and 436, and a look up table 102. The red LED controller 412 is electrically connected between the red LED series 202 and the ground source 210, the green LED controller 414 is electrically connected between the green LED series 204 and the ground source 210, and the blue LED controller 416 is electrically connected between the blue LED series 206 and the ground source 210. The processor 104 calculates analog voltages of the at least one second red, green, and blue LEDs respectively according to the difference between the T and T' matrices first, then through the DAC 418, transmits the analog voltage to the at least one second red LED to the red LED controllers 412 through the resistor dividers 422 and 432 to change the current flowing through the red LED series 202 so as to adjust the luminance of the red LED series 202. Sequentially, the analog voltages are sent to the green and blue LED controllers 414 and 416 respectively, through the pairs of the resistor dividers 424 and 434, and 426 and 436, and the currents flowing through the green and blue LED series 204 and 206 respectively are changed so as to adjust the luminance of the corresponding green and blue LED series 204 and 206.

To sum up, the present invention utilizes a look up table to store the matrices of values in the axes of the color gamut corresponding to the optical characteristics of the red, green, and blue LEDs respectively of the predetermined backlight module in white balance or without adjustment, and then generate the calibration matrix according to these two matrices so as to calculate the matrix of values in the axes of the color gamut corresponding to the optical characteristics of the red, green, and blue LEDs respectively of a backlight module intended to be adjusted. Then adjust the PWM signals transmitted to the LEDs or the currents flowing through the LEDs to change the luminance of the LEDs contained in the backlight module to get white balance. The present invention is capable of adjusting the backlight module and the panel to white balance effectively and rapidly.

Those skilled in the art will readily observe that numerous modifications and alterations of the device and method may be made while retaining the teachings of the invention.

What is claimed is:

1. A method for adjusting white balance in a field sequential display (FSD) comprising:

generating a first matrix according to values in axes of a color gamut corresponding to optical characteristics of at least one first red light emitting diode (LED), at least one first green LED, and at least one first blue LED respectively;

storing the first matrix;

generating a second matrix according to values in the axes of the color gamut corresponding to the optical characteristics of the at least one first red LED, the at least one first green LED, and the at least one first blue LED respectively while in white balance;

storing the second matrix;

generating a third matrix according to values in the axes of the color gamut corresponding to optical characteristics of at least one second red LED, at least one second green LED, and at least one second blue LEDs respectively;

storing the third matrix;

generating a calibration matrix by multiplying the second matrix with an inverse of the first matrix;

generating a fourth matrix by multiplying the third matrix with the calibration matrix; and adjusting the optical characteristics of the at least one second red LED, the at least one second green LED, and the at least one second blue LED according to a calculation result corresponding to numerical differences between the second and fourth matrices.

2. The method of claim 1 wherein adjusting the optical characteristics of the at least one second red LED, the at least one second green LED, and the at least one second blue LED according to the calculation result corresponding to the numerical differences between the second and fourth matrices comprises adjusting duty ratios of pulse width modulation (PWM) of the at least one second red LED, the at least one second green LED, and the at least one second blue LEDs respectively according to the calculation result corresponding to the numerical differences between the second and fourth matrices.

3. The method of claim 1 wherein adjusting the optical characteristics of the at least one second red, green, and blue LEDs referring to the differences between the second and fourth matrices comprises adjusting currents flowing through the at least one second red, green, and blue LEDs respectively so as to change luminance of the at least one second red, green, and blue LEDs respectively referring to the differences between the second and fourth matrices through analog voltages outputted from a digital/analog (D/A) converter.

4. A method for adjusting white balance in a field sequential display (FSD) comprising:

generating a first matrix according to values in axes of a color gamut corresponding to optical characteristics of at least one first red light emitting diode (LED), at least one first green LED, and at least one first blue LED respectively;

storing the first matrix;

generating a second matrix according to values in the axes of the color gamut corresponding to the optical characteristics of the at least one first red LED, the at least one first green LED, and the at least one first blue LEDs respectively while in white balance;

storing the second matrix;

generating a calibration matrix by multiplying the second matrix with an inverse of the first matrix;

storing the calibration matrix;

generating a third matrix according to values in the axes of the color gamut corresponding to optical characteristics of at least one second red LED, at least one second green LED, and at least one second blue LEDs respectively;

storing the third matrix;

calculating a fourth matrix by multiplying the third matrix with the calibration matrix; and adjusting the optical characteristics of the at least one second red LED, the at least one second green LED, and the at least one second blue LED according to a calculation result corresponding to numerical differences between the second and fourth matrices.

5. The method of claim 4 wherein adjusting the optical characteristics of the at least one second red LED, the at least one second green LED, and the at least one second blue LED according to the calculation result corresponding to the numerical differences between the second and fourth matrices comprises adjusting duty ratios of pulse width modulation (PWM) of the at least one second red LED, the at least one second green LED, and the at least one second blue LEDs respectively according to the calculation result corresponding to the numerical differences between the second and fourth matrices.

6. The method of claim 4 wherein adjusting the optical characteristics of the at least one second red, green, and blue LEDs referring to the differences between the second and fourth matrices comprises adjusting currents flowing through the at least one second red, green, and blue LEDs respectively so as to change luminance of the at least one second red, green, and blue LEDs respectively referring to the differences between the second and fourth matrices through analog voltages outputted from a D/A converter.

7. A device for adjusting white balance in a field sequential display (FSD) comprising:

a first device for generating a first matrix according to values in axes of a color gamut corresponding to optical characteristics of at least one first red light emitting diode (LED), at least one first green LED, and at least one first blue LED respectively;

a second device for generating a second matrix according to values in the axes of the color gamut corresponding to the optical characteristics of the at least one first red LED, the at least one first green LED, and the at least one first blue LED respectively while in white balance;

a third device for generating a third matrix according to values in the axes of the color gamut corresponding to optical characteristics of at least one second red LED, at least one second green LED, and at least one second blue LED respectively;

a storing device for storing the first matrix, the second matrix, and the third matrix;

a calculating device for generating a calibration matrix by multiplying the second matrix with an inverse of the first matrix, and generating a fourth matrix by multiplying the third matrix with the calibration matrix; and an adjusting device for adjusting the optical characteristics of the at least one second red LED, the at least one second green LED, and the at least one second blue LED according to a calculation result corresponding to numerical differences between the second and fourth matrices.

8. The device of claim 7 wherein the adjusting device is for adjusting duty ratios of pulse width modulation (PWM) of the at least one second red LED, the at least one second green LED, and the at least one second blue LEDs respectively according to the calculation result corresponding to the numerical differences between the second and fourth matrices.

9. The device of claim 7 wherein the adjusting device is for adjusting currents flowing through the at least one second red, green, and blue LEDs respectively so as to change luminance of the at least one second red, green, and blue LEDs respectively referring to the differences between the second and fourth matrices through analog voltages outputted from a D/A converter.

10. A device for adjusting white balance in a field sequential display (FSD) comprising:

a first device for generating a first matrix according to values in axes of a color gamut corresponding to optical characteristics of at least one first red light emitting diode (LED), at least one first green LED, and at least one first blue LED respectively;

a second device for generating a second matrix according to values in the axes of the color gamut corresponding to the optical characteristics of the at least one first red LED, the at least one first green LED, and the at least one first blue LED respectively while in white balance;

a calculating device for calculating a calibration matrix by multiplying the second matrix with an inverse of the first matrix;

a third device for generating a third matrix according to values in the axes of the color gamut corresponding to optical characteristics of at least one second red LED, at least one second green LED, and at least one second blue LEDs respectively;

a storing device for storing the first matrix, the third matrix, and the calibration matrix; and an adjusting device for adjusting the optical characteristics of the at least one second red LED, the at least one second green LED, and the at least one second blue LED according to a calculation result corresponding to numerical differences between the second and a fourth matrices, wherein the fourth matrix is generated by multiplying the third matrix with the calibration matrix through the calculating device.

11. The device of claim 10 wherein the adjusting device is for adjusting duty ratios of pulse width modulation (PWM) of the at least one second red LED, the at least one second green LED, and the at least one second blue LED respectively according to the calculation result corresponding to the numerical differences between the second and fourth matrices.

12. The device of claim 10 wherein the adjusting device is for adjusting currents flowing through the at least one second red, green, and blue LEDs respectively so as to change luminance of the at least one second red, green, and blue LEDs respectively referring to the differences between the second and fourth matrices through analog voltages outputted from a D/A converter.

* * * * *